United States Patent [19]

Polan

[11] Patent Number: 5,007,648

[45] Date of Patent: Apr. 16, 1991

[54] GAME APPARATUS

[76] Inventor: Alvin F. Polan, 126 Spectator La., Owings Mills, Md. 21117

[21] Appl. No.: 437,690

[22] Filed: Nov. 17, 1989

[51] Int. Cl.[5] ..... A63F 3/00

[52] U.S. Cl. ..... 273/236

[58] Field of Search ..... 273/236, 264, 268, 271, 273/273, 282, 288

[56] References Cited

U.S. PATENT DOCUMENTS

| | | | |
|---|---|---|---|
| 943,435 | 12/1909 | Maris | 273/273 |
| 3,638,947 | 2/1972 | Hardesty | 273/273 |
| 3,677,549 | 7/1972 | Moscovich | 273/236 |
| 3,977,681 | 8/1976 | Deitrich | 273/236 |
| 4,138,120 | 2/1979 | Daitzman | 273/271 |
| 4,146,235 | 3/1979 | Brantovich | 273/273 |
| 4,244,581 | 1/1981 | Imatt | 273/288 |
| 4,285,522 | 8/1981 | Turner | 273/271 X |
| 4,463,952 | 8/1984 | Rowbal | 273/236 |
| 4,903,969 | 2/1990 | Williams, Jr. | 273/248 |

*Primary Examiner*—Edward M. Coven
*Assistant Examiner*—William E. Stoll
*Attorney, Agent, or Firm*—Rodger H. Flagg

[57] ABSTRACT

A game apparatus for two or more players, comprising a playing board having horizontal ranks and vertical rows forming an array of playing squares, with four sets of playing pieces, each set having distinct indicia disposed upon the front face of the playing pieces, with a border surrounding the array of playing squares on the playing board, and four distinct indicia similar to the indicia on the front face of the playing pieces disposed on the border of the playing board adjacent to each rank and row. There are at least as many playing pieces as there are playing squares in the array, with extra playing pieces withdrawn from play prior to the start of each game. Each player selects six playing pieces, and places one playing piece anywhere on the playing board, selecting a new playing piece from the drawing pile upon completion of each turn. Play alternates between players, until all the playing pieces have been played, without matching any indicia on any of the adjacent squares or adjacent border indicia. The winning player may receive points for each game won. Additional points may be awarded for each playing piece in the other player's hands upon completion of play. Bonus points may also be awarded for three or more identical indicia in each rank or row.

8 Claims, 2 Drawing Sheets

GAME APPARATUS

BACKGROUND OF THE INVENTION

1. Field of the invention

This invention relates generally to a board game, and more particularly to a board game having a playing board comprising a matrix of horizontal ranks and vertical rows forming a square array of playing squares, with a border adjacent to the square array. The border is marked with one of four distinct indicia adjacent to each rank and row.

Four sets of playing pieces are each marked on the front face with one of the four indicia marked upon the border of the playing board, adjacent to each rank and row of the square array.

To play, all playing pieces are turned with their front face indicia tuned down to form a drawing pile, and any number of playing pieces greater than the playing squares in the square array are removed from play without looking at the indicia on the front face.

Each player draws six playing pieces to begin play. Players alternate turns, placing any one of their playing pieces on any one of the playing squares, with the indicia front face up, without matching the indicia on any adjacent playing piece or adjacent border area. Upon completion of each play, the player draws one playing piece from the drawing pile to maintain six playing pieces in their hand, until all the playing pieces are removed from the drawing pile.

Play continues until one player plays all of their playing pieces on the playing board without matching any of the adjacent indicia, or until one player is blocked from playing their remaining playing pieces.

Points may be awarded to the winner, and additional points may be awarded to the winner for each playing piece remaining unplayed in the other players hands at game's end.

2. Description of the Prior Art

Board games utilizing playing pieces are numerous, and well known in the art. Checkers and Chess utilize a playing board of uniform size having alternating colors formed in eight rows and ranks. However, players are not allowed to place their playing pieces anywhere on the board, and strict rules govern the movement of the pieces on the board. The present invention, does not allow movement of the playing pieces once they have been played, until game's end.

4,463,952 discloses a color match board game, having 64 squares and 48 chips. The chips are divided into four triangular areas and colored in one of six colors. The border adjacent to each rank and row is marked with one of three colors. The player must place one of his chips adjacent to a similar color at the edge of the board. To continue play, similar colors must match on all adjacent squares.

4,244,581 discloses a game with pieces preventing adjacent placement. The playing pieces include at least two separate sets of playing pieces, with each player having all the playing pieces in each set. No border indicia is disclosed or required.

4,138,120 discloses a board game utilizing sixteen playing pieces and sixteen squares arranged in four rows and four columns. The playing pieces comprise four sets of four pieces in each set. Two concepts, such as shape and color are combined on each playing piece. Each player receives a set having identical characteristics.

Play alternates, and points are scored for three or four like characteristics in series, by each player.

The game of TIC-TAC-TOE is also known in the art. Three columns and three rows form a matrix of nine playing squares, and the players selectively place their mark (such as X or O) upon the board in an attempt to align three of their marks in a row. If no one aligns three of their marks in a row, the game is declaired a draw.

The present game may be played with or without points; is played with a playing board having an array of ranks and rows, and four sets of playing pieces having a number equal to o greater than the number of playing squares in the square array. Applicant's game does not require cards, dice or other apparatus; may be played by two, three, four players or more players; and does not require complicated rules to provide an enjoyable game for children or adults.

SUMMARY OF THE INVENTION

The present invention comprises a playing board having a square matrix of horizontal ranks and vertical rows forming a playing board having a square array of playing squares. Four sets of playing pieces each have a common, readily identifiable indicia disposed upon the front face of each playing piece. The indicia is selected from one of four readily identifiable indicia, such as color, symbol, pattern or mark. The back side of each playing piece may have indicia common to all four sets of playing pieces. The border adjacent to each rank and row is marked with one of the four indicia used to identify each of the fours sets of indicia on the playing pieces.

Preferably, the indicia marked on the border of the playing board adjacent to each rank and row is positioned to alternate each of the four indicia used of the four sets of playing pieces. To begin play, all playing pieces are turned face down to hide the four sets of indicia marked on the face of each playing piece, and to form a drawing pile. The playing pieces are well mixed, and any playing pieces in excess of the number of playing squares are removed from play without looking at the indicia on the front face of the playing pieces.

The players each select six playing pieces, without revealing the indicia on the front face of the playing pieces to their opponents. Play alternates, with each player placing one of their playing pieces front face up on a playing square anywhere on the playing board, without matching indicia on any adjacent playing piece or adjacent border indicia. Upon completion of each play, the player withdraws a playing piece from the drawing pile until all the playing pieces are in the players hands.

Play continues until one player plays all their playing pieces upon the board, or until one layer cannot play any of their remaining playing pieces.

Points may be scored to the winner, and additional points may scored by the winner for each playing piece remaining in a player's hand at the end of each game. Points also may be scored by the winner for three or four similar indicia found in each rank and row at the end of the game.

The novel features of this invention, and other objects and advantages, will become apparent to one of average skill in this art, upon further examination of the specification and claims, when taken together with the following drawings.

DESCRIPTION OF THE PREFERRED EMBODIMENT

Figure 1:
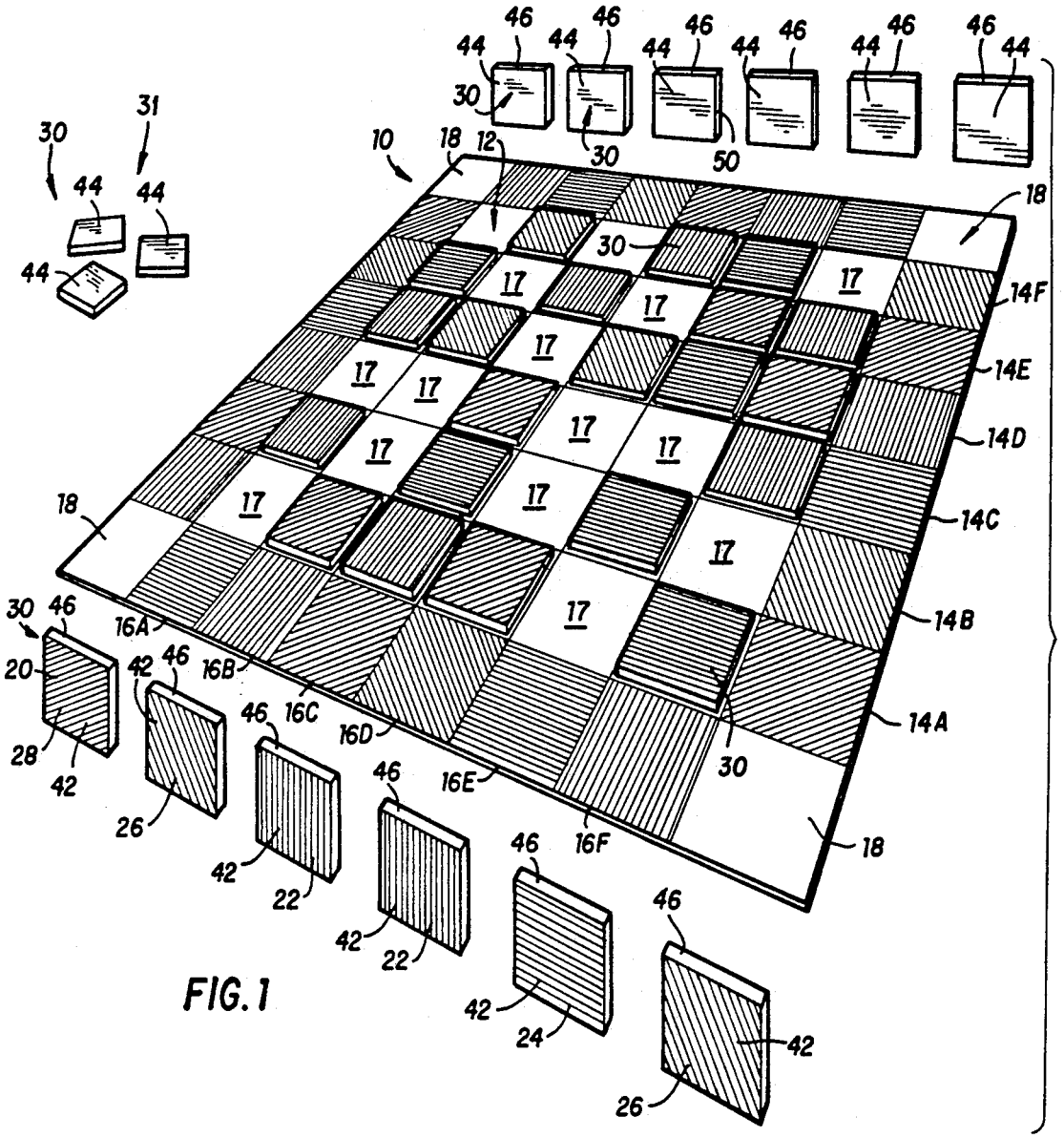
FIG. 1 is a perspective view of a preferred embodiment of the game showing a playing board having a matrix of six horizontal ranks, and six vertical rows, with adjacent border areas marked with one of four distinct indicia, and playing pieces disposed thereon, with six playing pieces in each players hand, and a drawing pile positioned adjacent to the playing board.

Referring to the preferred embodiment shown in FIG. 1, the playing board, generally designated 10, comprises a square array 12 preferably formed of six horizontal ranks 14A, 14B, 14C, 14D, 14E and 14F, and six vertical rows 16A, 16B, 16C, 16D, 16E and 16F, forming an array 12 of thirty six playing spaces or squares 17. Adjacent to each rank 14 and row 16 on the playing board 10 is a border 18, identified by one of four indicia, 22, 24, 26 and 28. The number of ranks 14 and rows 16 may be varied to suit manufacturing preference, from a minimum of four ranks 14 and four rows 16 to a maximum of twenty ranks 14 and twenty rows 16, or more. A playing board 10 with six ranks 14 and six rows 16 being the preferred embodiment shown in FIG. 1.

Figure 3:
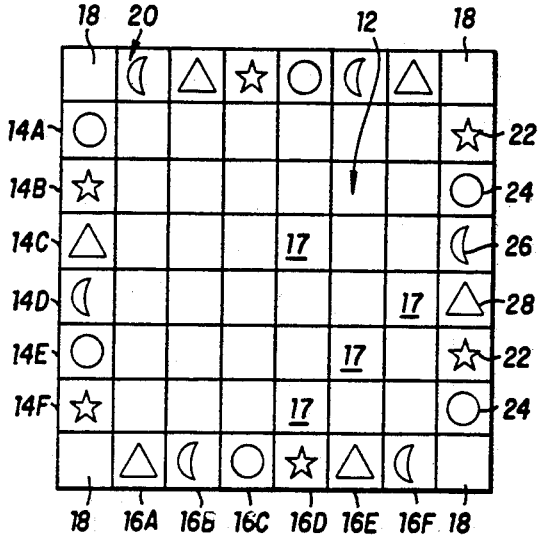
FIG. 3 is a top view of one embodiment of the playing board, showing four indicia alternately marked upon the border adjacent to each rank and row, with all of the playing pieces removed from the playing board, prior to begining play.
Figure 4:
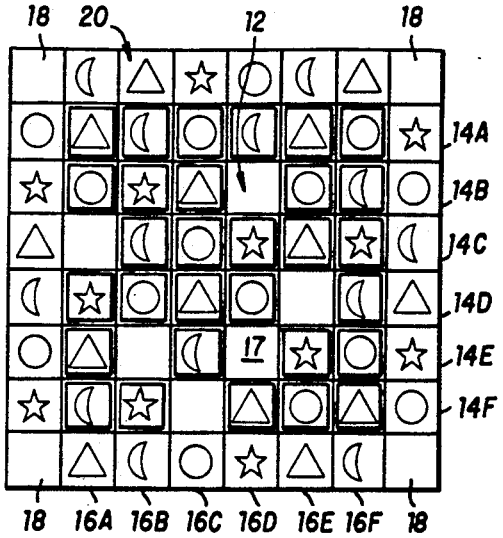
FIG. 4 is a top view of one embodiment of the playing board of FIG. 3, wherein six playing squares remain blocked from further play, without matching identical indicia on one of the adjacent playing squares or adjacent border indicia.
Figure 5:
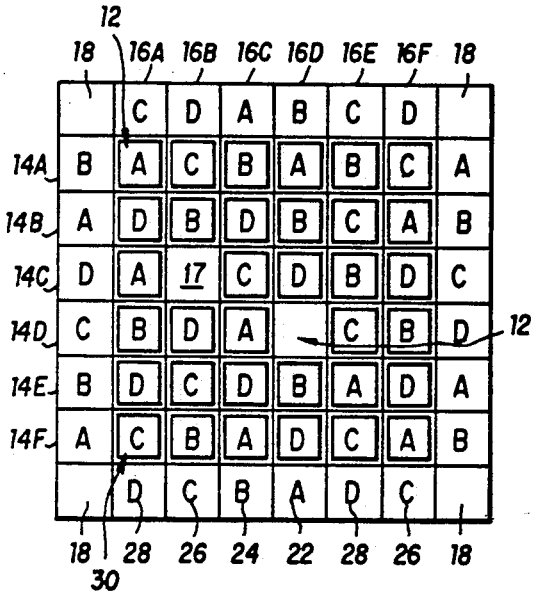
FIG. 5 is a top view of an alternate embodiment of the playing board, wherein two playing squares remain blocked from further play, without matching identical indicia on one of the adjacent playing squares or adjacent border indicia.
Figure 6:
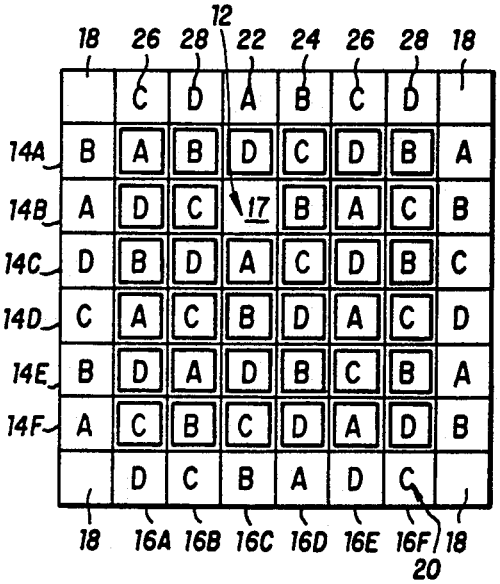
FIG. 6 is a top view of another embodiment of the playing board, wherein one playing square remains blocked from further play, without matching identical indicia on one of the adjacent playing squares or adjacent border indicia.

The indicia 20 may be a symbol of an object, person or thing as shown in FIG. 3 and 4, a distinct color or texture or pattern as shown in FIG. 1, or may be selected from commonly known numbers, letters, words or combinations thereof, as shown in FIG. 5 and 6. The indicia 20 is selected to provide four distinct and easily identifiable indicia, 22, 24, 26 and 28, which are placed in any known manner, such as by printing, silk screening, etc. upon the border 18 adjacent to each rank 16 and row 14 in the square array 12, preferably in alternating order.

Figure 2:
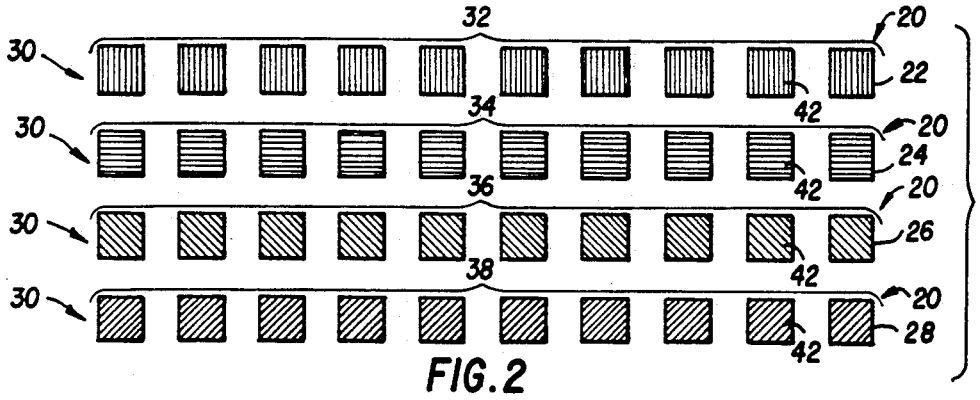
FIG. 2 is a front face view of fours sets of playing pieces shown face up, each set with one of four indicia disposed thereon.

Four sets 32, 34, 36 and 38 of playing pieces 30 are each marked with one of four indicia 22, 24, 26, 28 on the front face 42 of each playing piece 80. Each playing piece 30 is preferably square and sized to substantially cover one of the playing squares 17 on square array 12. The four sets of playing pieces 32, 34, 36 and 38 each contain an equal number of playing pieces as shown in FIG. 2.

Where six ranks 14 and six rows 16 form the square array 12, as shown in FIG. 1, there are preferably ten playing pieces 30 in each set. That leaves four more playing pieces 30 than the thirty-six playing squares 17 in the square array 12. Therefore, four playing pieces 30 are withdrawn from play at the beginning of the game. If there are nine playing pieces 30 in each set, there would be thirty-six playing pieces 30 and thirty-six playing squares 17, and no playing pieces 30 would be withdrawn from play at the beginning of the game.

Where five ranks 14 and five rows 16 form the square array 12 not shown), there would be preferably seven playing pieces 30 in each set, and three playing pieces 30 Would be withdrawn from play at the beginning of the game. Where seven ranks 14 and seven rows 16 form the array 12, there would be thirteen playing pieces 30 in each set, and three playing pieces 30 would be removed at the beginning of the game.

Where eight ranks 14 and eight rows 16 form the array 12, there would preferably be seventeen playing pieces 30 in each set, and four playing pieces 30 would be removed at the beginning of the game. If sixteen playing pieces 30 were used in each set, there would be sixty-four playing pieces 30 and sixty-four playing squares 17, and no playing pieces would be removed at the beginning of the game.

Thus while the preferred embodiment of six ranks 14 and six rows 16 form the preferred array 12, it is well within the skill of one skilled in this art to reduce or increase the ranks 14 and rows 16 in a square array 12 without departing from the spirit or scope of this invention. Of course, as the rank 16 and row 14 are made increased or decreased, the four sets of playing pieces are also correspondingly made increased or decreased.

Where the number of playing pieces 30 is greater than the number of playing squares 17 in the square array 12, the excess playing pieces 30 are withdrawn from the drawing pile 31 at the beginning of play. Where four playing pieces 30 or less are withdrawn from play, the withdrawn playing pieces 30 may be placed upon the border 18 at the four corners of the playing board.

Alternately, the playing pieces 30 withdrawn from play may be removed to any convenient location (not shown). Preferably, the excess playing pieces 30 are withdrawn from play without looking at the indicia 20 on the front face 42, as the uncertainty as to the identity of the withdrawn indicia 20 adds to the challenge of the game, and varies from game to game.

Where the number of playing pieces 30 is equal to the number of playing squares 17 in the square array 12, it is possible to eliminate the removal of playing pieces 30 prior to the start of the game. However, in the preferred embodiment, there are more playing pieces 30 than playing squares 17 in the array 12.

Figure 7:
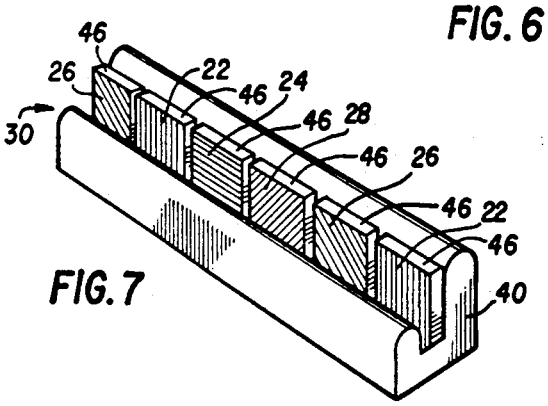
FIG. 7 is a perspective view of a holder sized to hold six playing pieces.

Each playing piece 30 is preferably shaped to substantially cover one playing square 17 as shown in FIG. 1. Each playing piece 30 is preferably of a thickness to enable a player to stand each playing piece 30 on end 46 on a reasonably horizontal surface, as shown in FIG. 1. Alternately, a holder 40 may be used to hold six playing pieces 30, as shown in FIG. 7. Each playing piece 30 has a front face 42, a back 44 and four sides 46. In an alternate embodiment, the playing pieces 30 may be in the form of cards, of thin cross section, for ease of holding six cards in the player's hand. The cards are preferably sized to substantially cover one of the playing squares 12 on the playing array 12.

The back 44 of each playing piece 30 may be marked with a fifth indicia common to all four sets of playing pieces 32, 24, 36, 38. The fifth indicia may be used to identify the game, the manufacturer of the game, or a suitable trademark, etc. and serves to readily identify all playing pieces 30 when they are placed face down 44 in the drawing pile, as shown in FIG. 1.

Each playing piece 30 is preferably made of a plastic material and may be molded into a common shape for uniform appearance. Other known materials, such as Wood, metal, paper, clay or glass, may be employed without departing from the scope of this invention.

The indicia 20 may be molded into each playing piece 30, or may be silk screened, or otherwise printed, etched or marked in any known manner.

The playing board 10 may be made of any conventional rigid or pliable material, such as cardboard, paper, leather, plastic, wood or metal, etc. Where rigid, the playing board 10 may be joined in sections for ease of folding. Where pliable, the playing board 10 may be rolled or folded, for ease of transport or storage.

The playing board 10 and playing pieces 30 may be boxed or bagged in a suitable enclosure to suit manufacturing preference. Preferably, the enclosure is sized to receive both the playing board 10 and the playing pieces 30, for ease of transport or storage.

The playing board 10 and playing pieces 30 may be manufactured in a variety of sizes to suit manufacturing preference. Preferably, each playing square 17 in the square array 12 will be greater than one/quarter of a square inch and less than three square inches.

It is within the scope of this invention to manufacture this game apparatus of magnetic playing board material and/or magnetic playing pieces, for use while traveling, etc., where the playing pieces 30 may accidentally fall from the playing board 10 during use. Alternately, the playing peaces 30 may be removably secured to the playing board 10 by other means, such as hook and loop type fasteners, etc. (not shown).

OPERATION OF THE PREFERRED EMBODIMENT

To play, all playing pieces 30 are turned front face 42 down with back 44 up so that none of the indicia 20 on the four sets of playing pieces 30 are observable to the players. The playing pieces 30 are then well mixed to form a drawing pile 31, and any playing pieces 30 greater than the number of playing squares 17 are removed from play without exposing the indicia on their front face 42. With six ranks 14, and six rows 16, and four sets 32. 34, 36 and 38 of ten playing pieces 30, there are thirty-six playing squares 17 forming the square array 12 and forty playing pieces 30.

Therefore, four playing pieces 30 are removed from play at the beginning of each game. This provides an unknown element, wherein the indicia 20 on the remaining playing pieces 30 cannot be counted to determine which playing pieces 30 remain to be drawn from the drawing pile 31, or reside in other players hands.

Each player then selects six playing pieces 30 from the drawing pile 31. The first player may be chosen in any conventional manner, such as size, age, the flip of a coin, the first player to draw a selected one of the four indicia, etc. The first player begins the game by placing one of their playing pieces face up 42 upon any one of the playing spaces 17 on the square array 12, being sure not to match indicia 20 on the playing piece with indicia on any adjacent playing piece or border 18 indicia 20.

Play alternates, with each player in turn placing one of their playing pieces 30 upon one of the playing squares 17 in the array 12. No player may place a playing piece 32 upon the array 12 where an adjacent playing piece 32 has identical indicia 20 thereon, or where an adjacent border 18 has identical indicia 20 thereon.

After each play, the player selects a new playing piece 30 from the drawing pile 31, to maintain six playing pieces 30 in each player's hand. This continues until all playing pieces 30 in the drawing pile 31 have been selected by the players.

Play continues until one player loses when they cannot place any of their remaining playing pieces 30 upon a vacant playing square 17 on the square array 12 without matching indicia 20 on their playing piece 30 with identical indicia 20 on an adjacent playing piece 30 or adjacent border 18 indicia 20.

A player may win by becomming the first player to play all of the playing pieces 30 in their hand in turn, upon the square array 12, without matching the indicia 20 on any adjacent playing piece 30, or adjacent border 18 indicia 20.

The winner may be awarded points for winning. The winner may also be awarded additional points for each playing piece 30 remaining in the other players hands at the end of each game. Bonus points may also be awarded for each rank 14 or row 16 having three or more common indicia in the rank 14 or row 16.

Do to the limitation of not having identical indicia 20 adjacent to any playing piece 30, there can be no more than three playing pieces 30 with identical indicia 20 in a given rank 14 or row 16 on a playing board 10 having six rows 16 and six ranks 14. Therefore, the bonus scoring should be adjusted according to the number of rows 16 and ranks 14 selected by the manufacturer.

Alternately, points may be dispensed with entirely without detracting from the novelty of play, or the challenge of winning.

Since the excess playing pieces 30 are removed without disclosing the indicia 20 thereon at the beginning of each game, it becomes difficult to second guess which indicia 20 your opponent retains in their hand near game's end. This adds additional interest to the game, and often provides an additional challenge for the players of the game.

Depending upon the placement of playing pieces 30 on the playing board 10 array 12, it is often not possible to play all the playing pieces 30 without matching indicia 20 on adjacent playing squares 17 or adjacent border 18 indicia 20.

As Shown in FIG. 4, there are six playing squares 17 that cannot be used, as all four indicia 22, 24, 26 and 28 surround the six unused playing squares 17. Note rank 14B, row 16D; rank 14C, row 16A; rank 14D, row 16E: rank 14E, row 16B; rank 14E, row i6D; and rank 14F, row 16C.

FIG. 5 shows two playing squares 17 that cannot be used due to the placement of adjacent playing pieces 30. Note Rank 14C, row 16B and Rank 14D, row 16D.

FIG. 6 shows one playing square 17 that cannot be used due to placement of adjacent playing pieces 30. Note Rank 14B, row 16C. Thus, it is apparent that many variations of play may be employed to challenge and outwit your opponents during the course of a game.

One feature of the present invention, is that this game apparatus may be played by two, three, four or more players without changing the rules, or departing from the enjoyment of play.

Another feature of the present invention, is that this game may be made with as few as four ranks 14 and rows 16, or as many as 20 or more ranks 14 and rows 16, according to the wishes of the manufacturer. The playing pieces 30 are selected of four equal sets 32, 34, 36 and 38 of playing pieces 30, which equal or exceed the number of playing squares 17 in the square array 12. Preferably there are up to four additional playing pieces 30, which are removed at the beginning of play.

The game may be enjoyed by young and old, and the elements of chance and skill are both apparent during play.

Thus, while the novel game apparatus has been fully described and disclosed, numerous modifications will become readily apparent to one of ordinary skill in this art, and such adaptations and modifications are intended to be included within the scope of the following claims.

What is claimed is:

1. A game apparatus, comprising:

(a) a playing board with 36 unmarked playing squares forming a square array having six horizontal ranks and six vertical rows, (b) a border extending around the square array, the border having six border squares on each side of the square array adjacent to each rank and row, with one of four distinct indicia marked upon each border square, distinct indicia being marked throughout the border spares with no adjacent border square having a similar indicia;

(c) four sets of ten playing pieces, each having a front face and a back face, with each set of ten playing pieces having a common indicia marked on the front face matching one of the four distinct indicia marked upon the border squares; the four sets of ten playing pieces each having the back face marked with a fifth indicia common to all four sets of ten playing pieces; and (d) wherein a playing piece is selectively positioned each in turn upon one of the unused playing squares on the square array front face up without matching indicia on the front face of any adjacent playing piece or adjacent border indicia, and once played each playing piece remains in place on the selected playing square for the duration of the game.

2. The game apparatus of claim 1, wherein the four distinct indicia are preferably selected from four easily identifiable colors.

3. The game apparatus of claim 1, wherein all four sets of ten playing pieces are initially turned back face up with the fifth indicia showing and intermixed to form a drawing pile; four playing pieces are randomly removed from the drawing pile and withdrawn from play, and the remaining playing pieces are then randomly selected from the drawing pile, and selectively placed front face upon one of the unused playing squares without matching the indicia the front face of any adjacent playing piece or adjacent border indicia, and remain in place upon the selected playing square for the duration of the game.

4. The game apparatus of claim 3, wherein each player withdraws six playing pieces from the drawing pile, and the players alternate turns by placing a selected playing piece upon one of the unmarked playing squares without matching identical indicia on the front side of the playing piece with indicia on the front side of any adjacent playing piece, or with indicia on any adjacent border indicia, and upon completion of each play, a new playing piece is selected from the drawing pile, until all pieces are withdrawn from the drawing pile.

5. The game apparatus of claim 3, wherein the four corners of the border whose sides are not adjacent to a horizontal rank or vertical row are used to receive the four playing pieces withdrawn from play, with the withdrawn playing pieces positioned front face down on the four corners without revealing the indicia on the front face of any of the four withdrawn playing pieces.

6. The game apparatus of claim 1, wherein each player in turn places a selected playing piece upon one of the unused playing squares in the square array, without matching indicia on the front face with indicia on the front face of any adjacent playing piece or adjacent border indicia, until one player wins by playing all their playing pieces upon unused squares in the square array, or no further play is possible without matching indicia on a playing piece with matching indicia on the front face of any adjacent indicia and with indicia on an adjacent border square.

7. The apparatus of claim 1, wherein points are awarded to the winner for each playing piece remaining unplayed upon the square array by each of the other players at the end of each game.

8. The game apparatus of claim 1, wherein the front and rear face of each playing piece is of a uniform size and shape, with an edge of sufficient thickness to enable each playing piece to stand on its edge on a reasonably flat, horizontal surface without falling over.

* * * * *